US010336084B2

(12) United States Patent
Takahashi

(10) Patent No.: US 10,336,084 B2
(45) Date of Patent: Jul. 2, 2019

(54) LIQUID CARTRIDGE AND IMAGE FORMING APPARATUS USING THE SAME

(71) Applicant: BROTHER KOGYO KABUSHIKI KAISHA, Nagoya-shi, Aichi-ken (JP)

(72) Inventor: Hiroaki Takahashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/664,059

(22) Filed: Jul. 31, 2017

(65) Prior Publication Data

US 2018/0178531 A1 Jun. 28, 2018

(30) Foreign Application Priority Data

Dec. 28, 2016 (JP) ..... 2016-255350

(51) Int. Cl.
*B41J 2/175* (2006.01)

(52) U.S. Cl.
CPC ..... *B41J 2/17513* (2013.01); *B41J 2/175* (2013.01); *B41J 2/1752* (2013.01); *B41J 2/1753* (2013.01); *B41J 2/17509* (2013.01); *B41J 2/17523* (2013.01); *B41J 2/17553* (2013.01)

(58) Field of Classification Search
CPC ... B41J 2/17503; B41J 2/17513; B41J 2/1752
See application file for complete search history.

(56) References Cited

U.S. PATENT DOCUMENTS

2015/0273839 A1* 10/2015 Takata ..... B41J 2/17513 347/85

FOREIGN PATENT DOCUMENTS

| | | | | |
|---|---|---|---|---|
| EP | 2781358 A1 * | 9/2014 | ..... | B41J 2/175 |
| JP | 2014-180797 A | 9/2014 | | |
| JP | 2005-161637 A | 12/2015 | | |

* cited by examiner

*Primary Examiner* — Kristal Feggins
*Assistant Examiner* — Kendrick X Liu
(74) *Attorney, Agent, or Firm* — Merchant & Gould P.C.

(57) ABSTRACT

A liquid cartridge includes a front wall, a rear wall, a bottom wall, first and second storage chambers, a liquid flow path, and a communication opening. The rear wall is spaced away from the front wall in a rear direction perpendicular to a gravitational direction in an upright posture, and is spaced away from the front wall in an upward direction in a rotated posture. The communication opening is provided at the bottom wall and is configured to provide communication therethrough between the first and second storage chambers. The communication opening defines an imaginary horizontal plane. The first storage chamber in the rotated posture defines a first capacity above the imaginary horizontal plane and a second capacity below the imaginary horizontal plane. The first capacity is less than the second capacity. The liquid flow path is positioned downward relative to the imaginary horizontal plane in the rotated posture.

13 Claims, 11 Drawing Sheets

LIQUID CARTRIDGE AND IMAGE FORMING APPARATUS USING THE SAME

CROSS REFERENCE TO RELATED APPLICATION

This application claims priority from Japanese Patent Application No. 2016-255350 filed Dec. 28, 2016. The entire content of the priority application is incorporated herein by reference.

TECHNICAL FIELD

The present disclosure relates to a liquid cartridge and an image forming apparatus in which the liquid cartridge is mountable.

BACKGROUND

There are known printers provided with a recording head that ejects ink supplied from an ink cartridge through a nozzle. The ink cartridge has a main tank, and the main tank is connected to a sub tank of the recording head so that the ink can flow therebetween when the ink cartridge is mounted in or attached to the printer. Accordingly, the ink cartridge can supply ink to the recording head.

SUMMARY

One type of the above-described printers can be used in a use posture where the ink cartridge is positioned upward and the recording head is positioned downward. In the use posture, the ink cartridge and the recording head are arranged in the horizontal direction. On the other hand, another posture may be used in the shipment or the packing operation of the ink cartridge and the printer. For example, the printer may set in a posture where the front wall of the printer is positioned upward and the rear wall is positioned downward. In this case, the ink cartridge is positioned upward and the recording head is positioned downward. Further, the printer may be inclined from the use posture when the user moves the printer. As a result, the ink cartridge may be positioned above the nozzle surface of the recording head.

The meniscus in the opening of the nozzle may be broken by the vibration caused in the shipment, the packing operation, or the movement of the printer. When the meniscus in the opening is broken, the ink may flow out of the recording head because the own weight of the ink exerts pressure on the ink. Further, when the ink cartridge is positioned upward of the nozzle surface in a state where the printer is inclined from the use posture, the ink generates water head pressure from the ink cartridge to the nozzle surface. The water head pressure may cause the ink stored in the ink cartridge to leak from the recording head. Specifically, the amount of leaked ink can be increased when the recording head is not covered by a cap, if compared to the case where the recording head is covered.

When the printer malfunctions, the user may pack and ship the printer and the cartridge in a state where the ink cartridge is mounted in the printer. The printer is inclined from the use posture at least when the user packs to ship the printer. In the case, the ink stored in the ink cartridge may leak from the recording head. It is preferable to reduce the amount of ink leakage. Further, when the ink cartridge has large capacity, the amount of ink leakage can be increased since the large amount of ink is stored. The ink leakage should be specifically suppressed when the ink cartridge has large capacity.

The present disclosure has been made in view of at least one of the above situations, it is a possible object of the present disclosure to provide a liquid cartridge that can reduce the amount of liquid leaking from the liquid cartridge when the liquid cartridge is inclined from the use posture.

According to one aspect, the disclosure provides a liquid cartridge including a front wall, a rear wall, a bottom wall, first and second storage chambers, a liquid flow path, and a communication opening. The rear wall is spaced away from the front wall in a rear direction perpendicular to a gravitational direction in an upright posture. The rear wall is spaced away from the front wall in an upward direction opposite to the gravitational direction in a rotated posture. The bottom wall extends in a direction crossing the gravitational direction in the upright posture. The first storage chamber is configured to store liquid and having a bottom portion defined by the bottom wall in the upright posture. The second storage chamber is positioned downward relative to the first storage chamber in the upright posture. The second storage chamber has capacity less than capacity of the first storage chamber. The liquid flow path is positioned frontward relative to the rear wall in the upright posture and is configured to provide communication therethrough between the second storage chamber and an outside of the liquid cartridge. The communication opening is provided at the bottom wall and is configured to provide communication therethrough between the first storage chamber and the second storage chamber. The communication opening has a first end portion and a second end portion positioned downward relative to the first end portion in the rotated posture. The communication opening defines an imaginary horizontal plane extends perpendicular to the gravitational direction in the rotated posture. The imaginary horizontal plane includes the second end portion of the communication opening. The first storage chamber in the rotated posture defines a first capacity above the imaginary horizontal plane and a second capacity below the imaginary horizontal plane. The first capacity is less than the second capacity. The liquid flow path is positioned downward relative to the imaginary horizontal plane in the rotated posture.

According to another aspect, the disclosure provides an image forming apparatus including a liquid cartridge and a cartridge attachment portion, a cartridge attachment portion, a tank, and a recording head. The liquid cartridge includes a front wall, a rear wall, a bottom wall, first and second storage chambers, a liquid flow path, and a communication opening. The rear wall is spaced away from the front wall in a rear direction perpendicular to a gravitational direction in an upright posture. The rear wall is spaced away from the front wall in an upward direction opposite to the gravitational direction in a rotated posture. The bottom wall extends in a direction crossing the gravitational direction in the upright posture. The first storage chamber is configured to store liquid and having a bottom portion defined by the bottom wall in the upright posture. The second storage chamber is positioned downward relative to the first storage chamber in the upright posture. The second storage chamber has capacity less than capacity of the first storage chamber. The liquid flow path is positioned frontward relative to the rear wall in the upright posture and is configured to provide communication therethrough between the second storage chamber and an outside of the liquid cartridge. The communication opening is provided at the bottom wall and is configured to provide communication therethrough between the first storage chamber and the second storage chamber. The communication opening has a first end portion and a second end portion positioned downward relative to the first end portion in the rotated posture. The communication opening defines an imaginary horizontal plane extends perpendicular to the gravitational direction in the rotated posture. The imaginary horizontal plane includes the second end portion of the communication opening. The first storage chamber in the rotated posture defines a first capacity above the imaginary horizontal plane and a second capacity below the imaginary horizontal plane. The first capacity is less than the second capacity. The liquid flow path is positioned downward relative to the imaginary horizontal plane in the rotated posture. The cartridge attachment portion has a connector configured to be connected to the liquid flow path. The tank has a third storage chamber configured to store the liquid supplied from the connector. The recording head has a nozzle configured to eject the liquid supplied from the third storage chamber.

BRIEF DESCRIPTION OF THE DRAWINGS

The particular features and advantages of the disclosure will become apparent from the following description taken in connection with the accompanying drawings, in which.

DETAILED DESCRIPTION

Figure 1:
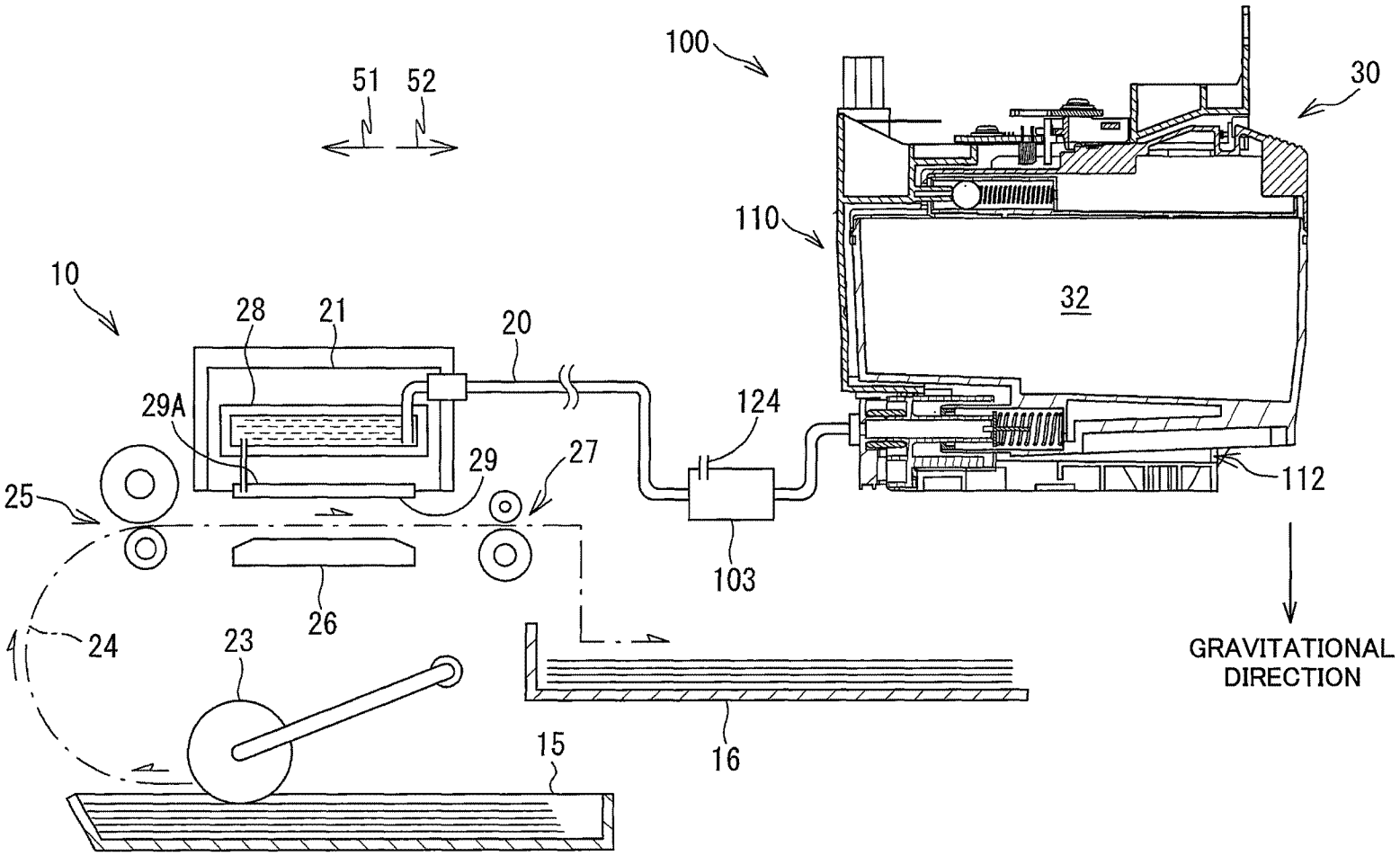
FIG. 1 is a schematic cross-sectional diagram conceptually showing an internal configuration of a printer including a cartridge-attachment section configured to detachably accommodate ink cartridges according to an embodiment.

An ink cartridge 30 according to an embodiment will be described while referring to the accompanying drawings wherein like parts and components are designated by the same reference numerals to avoid duplicating description.

In the following description, the direction in which an ink cartridge 30 is inserted into a cartridge-attachment section 110 is defined as a frontward direction 51. The direction in which the ink cartridge 30 is removed from the cartridge-attachment section 110 is defined as a rearward direction 52. The ink cartridge 30 is inserted into and removed from the cartridge-attachment section 110 in the horizontal direction. Thus, the frontward direction 51 and rearward direction 52 are assumed to be horizontal. The direction perpendicular to the frontward direction 51 or rearward direction 52 is defined as a downward direction 53, and the down ward direction 53 is substantially coincident with the gravitational direction in a state where the ink cartridge 30 is in an upright posture. The direction opposite to the downward direction 53 is an upward direction 54. The direction perpendicular to both the frontward and downward directions 51 and 53 is defined as a rightward direction 55. The direction opposite to the rightward direction 55 is defined as a leftward direction 56. In the description, in a use state in which the ink cartridge 30 is attached to the cartridge-attachment section 110, the gravitational direction is assume to be the downward direction 53, and the direction opposite to the gravitational direction is assumed to be the upward direction 54. That is, in a use state in which the ink cartridge 30 is attached to the cartridge-attachment section 110, the outer surface of a lower wall 42 of a cartridge body 31 faces downward in the gravitational direction. Further, the directions perpendicular to both the frontward and rearward directions 51 and 52 are defined as the rightward and leftward directions 55 and 56. More specifically, when the ink cartridge 30 is viewed from the rear side in the front-rear direction in a use state where the ink cartridge 30 is inserted into the cartridge-attachment section 110, the direction facing the right side is defined as the rightward direction 55, and the direction facing the left side is defined as the leftward direction 56. Incidentally, the use state where the ink cartridge 30 is attached to the cartridge-attachment section 110 is a state where the ink cartridge 30 is inserted to an attached position of the cartridge-attachment section 110. Hereinafter, the posture of the ink cartridge 30 in the above use state is referred to as "use posture" or "upright posture".

Note that the upright posture is a posture where the ink cartridge 30 is inserted to the cartridge attachment section 110. That is, an ink supply portion 34, described later, faces in a direction crossing the gravitational direction in the upright posture.

Further, in the following description, the frontward direction 51 and the rearward direction 52 may be collectively referred to as a front-rear direction. The upward direction 54 and the downward direction 53 may be collectively referred to as an up-down direction. The rightward direction 55 and the leftward direction 56 may be collectively referred to as a left-right direction or widthwise direction.

Note that the directions, depth, height, and width in the specification are based on the directions in the upright posture, the use posture, or a rotated posture, described later, of the ink cartridge 30, unless otherwise specified. In this specification, "facing frontward" includes facing in a direction including a frontward component, "facing rearward" includes facing in a direction including a rearward component, "facing downward" includes facing in a direction including a downward component, and "facing upward" includes facing in a direction including an upward component. For example, "a front surface faces frontward" denotes that the front surface may face in a frontward direction, or the front surface may face in a direction inclined relative to the frontward direction.

<Outline of Printer 10>

As illustrated in FIG. 1, a printer 10 is an image recording apparatus that records an image by ejecting ink droplets to a paper sheet based on an inkjet recording system and is, for example an inkjet printer. The printer 10 includes a recording head 21, an ink-supplying device 100, and an ink tube 20 connecting the recording head 21 and ink-supplying device 100. The ink-supplying device 100 is provided with a cartridge-attachment section 110. The ink cartridge 30 is attached to the cartridge-attachment section 110. The cartridge-attachment section 110 has an opening 112 formed in one surface thereof. The ink cartridge 30 is inserted frontward into the cartridge-attachment section 110 through the opening 112, or removed rearward from the cartridge-attachment section 110 through the opening 112.

The ink cartridge 30 stores ink. For example, the ink cartridge 30 stores ink usable in the printer 10. In a state where attachment of the ink cartridge 30 to the cartridge-attachment section 110 is completed, the ink cartridge 30 and the recording head 21 are connected to each other by the ink tube 20. The recording head 21 has a damper chamber 28 for temporarily store ink supplied through the ink tube 20. The recording head 21 ejects ink supplied from the damper chamber 28 from a plurality of nozzles 29. Specifically, a drive voltage is selectively applied from a head control board provided in the recording head 21 to a plurality of piezoelectric elements 29A provided corresponding to the plurality of nozzles 29. As a result, ink is ejected selectively from the nozzles 29. That is, the recording head 21 consumes the ink stored in the ink cartridge 30 attached to the cartridge-attachment section 110.

The printer 10 is provided with a sheet tray 15, a feeding roller 23, a conveying roller pair 25, a platen 26, a discharge roller pair 27, and a sheet discharge tray 16. The feeding roller 23 feeds a paper sheet on the sheet tray 15 toward a conveying path 24. The paper sheet fed to the conveying path 24 reaches the conveying roller pair 25. The conveying roller pair 25 then conveys the paper sheet onto the platen 26. The recording head 21 selectively ejects ink onto the paper sheet passing on the platen 26. As a result, an image is recorded on the paper sheet. The paper sheet passing through the platen 26 reaches the discharge roller pair 27. Then, the discharge roller pair 27 discharges the paper sheet to the sheet discharge tray 16 provided at the most downstream side of the conveying path 24.

<Ink Supply Device 100>

As illustrated in FIG. 1, the printer 10 is provided with the ink-supplying device 100. The ink-supplying device 100 supplies ink to the recording head 21. The ink-supplying device 100 includes the cartridge-attachment section 110 that can be attached with the ink cartridge 30, a tank 103 (an example of a third storage chamber), and an ink tube 20. FIG. 1 illustrates a state where attachment of the ink cartridge 30 to the cartridge-attachment section 110 is completed. That is, in FIG. 1, the ink cartridge 30 is in an attachment state. The posture of the ink cartridge 30 in this state is the use posture.

<Cartridge-Attachment Section 110>

Figure 2:
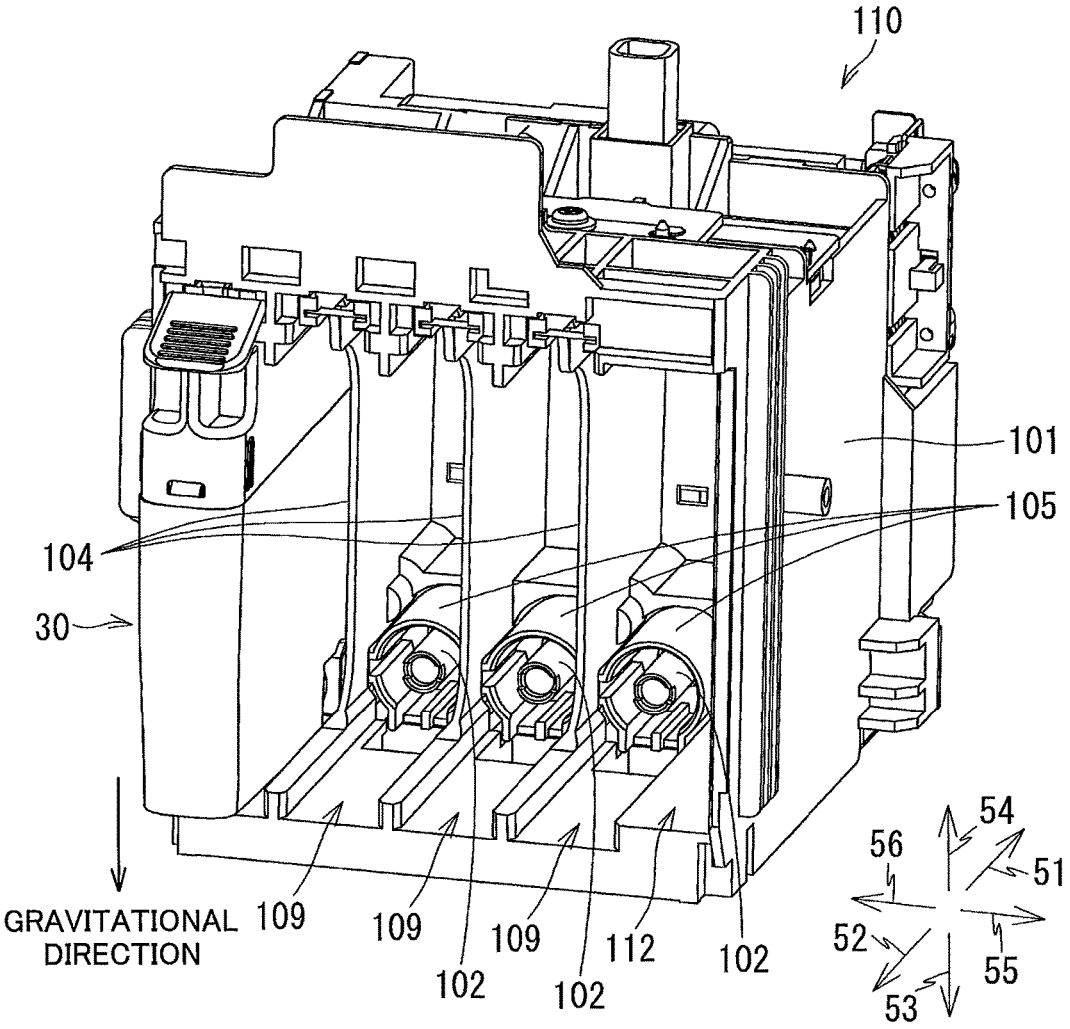
FIG. 2 is a perspective view showing an external appearance of the cartridge-attachment section and an opening of the cartridge-attachment section.
Figure 3:
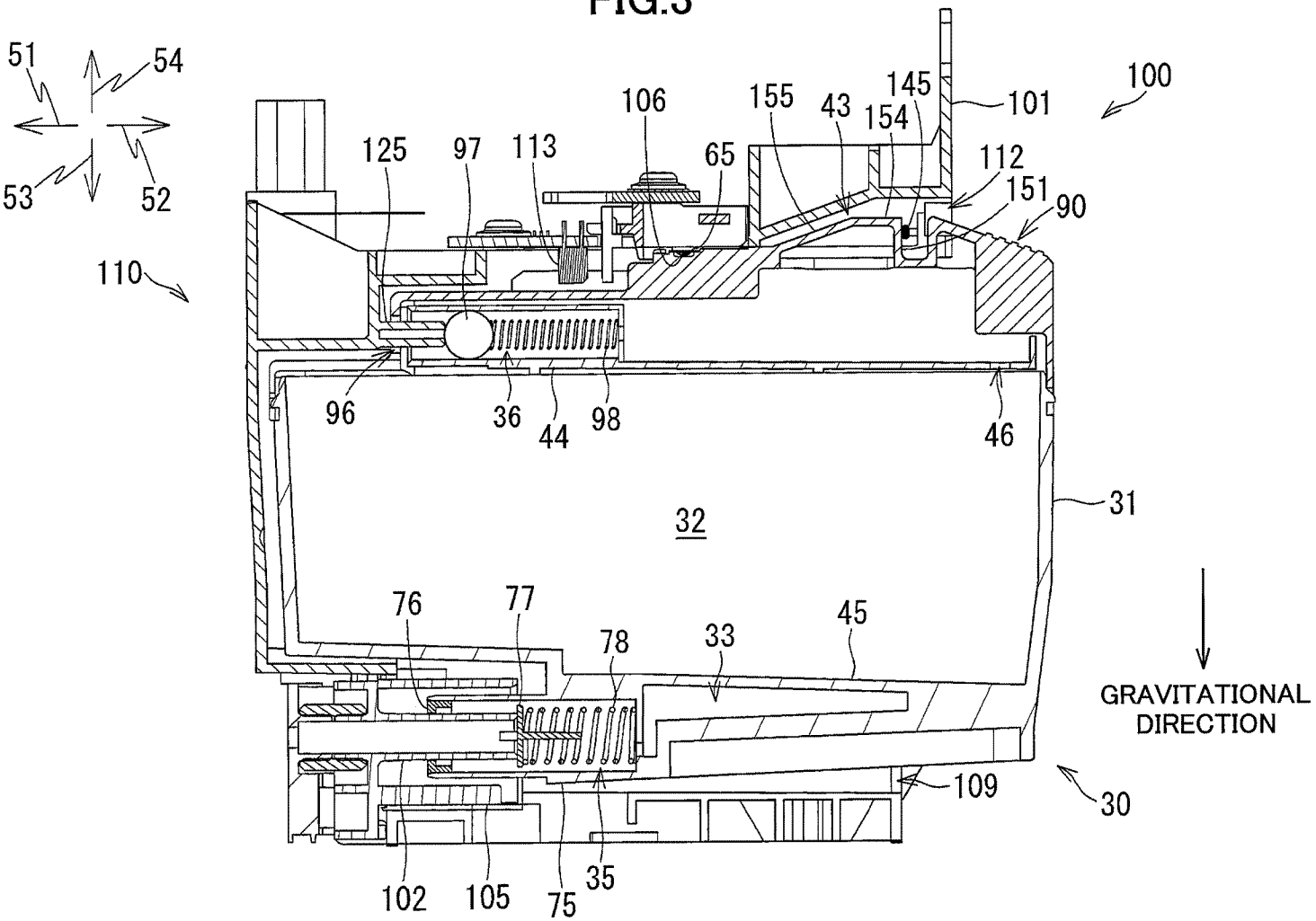
FIG. 3 is a cross-sectional view of the cartridge-attachment section in a state where the ink cartridge according to the embodiment is inserted into the cartridge-attachment section.

As shown in FIGS. 1 through 3, the cartridge-attachment section 110 includes a cartridge case 101, and further includes four sets of an ink needle 102 (an example of a connector), an optical sensor 113, four contacts 106. Here, each set is for each of the four types of ink cartridges, which correspond to the colors of cyan, magenta, yellow and black.

A set of the four contacts 106 is provided for each of the four insertion spaces of the cartridge case 101. As illustrated in FIG. 3, each of the four sets of the contacts 106 is disposed at the top wall of the cartridge case 101, for each insertion space corresponding to each ink cartridge 30. That is, sixteen contacts 106 correspond to each of the ink cartridge 30. Four sets of the tank 103 and ink tube 20 correspond to each of four ink cartridges 30, and are disposed in the cartridge case 101.

<Cartridge Case 101>

As illustrated in FIG. 2, the cartridge case 101 forms a housing of the cartridge-attachment section 110. The cartridge case 101 has a box-like shape having a upper surface, a bottom surface, an end surface, and the opening 112. The upper surface defines a top part forming an upper portion of the inner space of the cartridge case 101. The bottom surface defines a bottom part forming a lower portion of the inner space of the cartridge case 101. The end surface connects the top part and bottom part of the inner space of the cartridge case 101. The opening 112 is formed in the cartridge case 101 so as to be opposed to the end surface in the front-rear direction. The opening 112 can be exposed to a user interface surface of the printer 10 which is the surface that a user faces when he or she uses the printer 10.

The ink cartridge 30 can be inserted into or removed from the cartridge case 101 through the opening 112. A guide groove 109 is formed in the bottom part of the cartridge case 101. When the lower end portion of the ink cartridge 30 is inserted into the guide groove 109, the ink cartridge 30 is guided in the frontward and rearward directions 51 and 52 as illustrated in FIG. 2. The cartridge case 101 has three plates 104 partitioning the inner space of the cartridge case 101 into the four vertically long spaces. One ink cartridge 30 is housed in each of the spaces partitioned by the three plates 104.

<Ink Needle 102>

As illustrated in FIG. 2, the ink needle 102 has a tubular shape and positioned at the lower portion of the end surface of the cartridge case 101. At the end surface of the cartridge case 101, the ink needle 102 is positioned so as to correspond to an ink supply portion 34 of the ink cartridge 30 attached to the cartridge-attachment section 110. The ink needle 102 protrudes rearward from the end surface of the cartridge case 101.

A guide portion 105 generally having a cylindrical shape is disposed around the ink needle 102 in the cartridge case 101. The guide portion 105 protrudes rearward from the end surface of the cartridge case 101 and has an opening protrusion having an open end. The ink needle 102 is disposed at the center portion of the guide portion 105. The guide portion 105 has a shape into which the ink supply portion 34 of the ink cartridge 30 enters inward.

During insertion of the ink cartridge 30 into the cartridge-attachment section 110 in the frontward direction 51, i.e., in a process for the ink cartridge 30 to move to the attached position, the ink supply portion 34 of the ink cartridge 30 enters the corresponding guide portion 105 (refer to FIG. 3).

As the ink cartridge 30 is inserted further forward in the frontward direction 51, the ink needle 102 enters an ink supply port 71 of the corresponding ink supply portion 34. The ink needle 102 is thus connected to the corresponding ink supply portion 34 to allow communication with each other. Hence, the ink stored in a second storage chamber 33 formed inside the ink cartridge 30 is allowed to flow into the corresponding tank 103 through an ink valve chamber 35 that is defined in the ink supply portion 34 and an inner space that is defined in the corresponding ink needle 102. Incidentally, the end portion of the ink needle 102 may be flat-shaped tip end or a pointed tip end.

<Contacts 106>

A set of the four contacts 106 is provided for each of the four insertion spaces of the cartridge case 101. Here, the ink cartridges 30 can be inserted into each of the four insertion spaces. As illustrated in FIG. 3, each of the four sets of the contacts 106 is disposed at the top wall of the cartridge case 101, for each insertion space, at a position near the end wall of the cartridge case 101. Each of the four contacts 106 is disposed rearward relative to the corresponding ink needle 102. Each of the four contacts 106 protrude from a lower surface of the top wall downward toward the corresponding insertion space of the cartridge case 101. Although not illustrated in detail in the drawings, the four contacts 106 in each set are arranged to be spaced apart from one another in the left-right direction. The four contacts 106 in each set are arranged at positions respectively corresponding to four electrodes 65 provided at each of the ink cartridges 30, as will be described later. Each contact 106 is formed of a material having electrical conductivity and resiliency. The contacts 106 are therefore upwardly resiliently deformable.

In the present embodiment, the four sets of the four contacts 106 are disposed for each set of the four ink cartridges 30. That is, a total of sixteen contacts 106 are provided at the cartridge case 101. However, the number of contacts 106 and the number of electrodes 65 may be arbitrary.

Each contact 106 is electrically connected to a computing unit through an electric circuit. The computing unit includes, e.g., a CPU, a ROM and a RAM and functions as a controller for the printer 10. For example, when the contacts 106 and their corresponding electrodes 65 are brought into contact with each other to be electrically conducted, a voltage Vc is applied to the first electrode 65, the second electrode 65 is grounded, a signal representing data is transmitted to the third electrode 65, and a sync signal is transmitted from the computing unit to the fourth electrode 65. Electric conduction between the contact 106 and its corresponding electrode 65 allows the computing unit to access data stored in an IC of the ink cartridge 30. An output from each contact 106 is inputted to the computing unit through an electric circuit.

<Rod 125>

As illustrated in FIG. 3, a rod 125 is formed on the end surface of the cartridge case 101 at a position upward of the ink needle 102. The rod 125 protrudes rearward from the end surface of the cartridge case 101. The rod 125 has a cylindrical shape. In a state where the ink cartridge 30 is attached to the cartridge-attachment section 110, i.e., in a state where the ink cartridge 30 is located at the attached position, the rod 125 is inserted into an atmosphere communication port 96 to be described later.

<Optical Sensor 113>

As illustrated in FIG. 3, the optical sensor 113 is disposed on the upper surface of the cartridge case 101. The optical sensor 113 is positioned rearward of the rod 125 and frontward of the four contacts 106. The optical sensor 113 has a light emitter and a light receiver. The light emitter is disposed spaced apart rightward or leftward from the light receiver. A light-blocking plate 67 to be described later of the ink cartridge 30 attached to the cartridge-attachment section 110 is disposed between the light emitter and the light receiver. Further, a second light-blocking plate 267 to be described later of attached to the cartridge-attachment section 110 is disposed between the emitter and receiver. In other words, the light emitter and light receiver are disposed opposite to each other, so that the light-blocking plate 67 of the ink cartridge 30 or the second light-blocking plate 267 of attached to the cartridge-attachment section 110 is positioned between the light emitter and light receiver.

The optical sensor 113 outputs different detection signals according to whether or not light emitted from the light emitter in the left-right direction is received by the light receiver. For example, the optical sensor 113 outputs a low level signal on the condition that the light outputted from the light emitter cannot be received by the light receiver (that is, a received light intensity is smaller than a predetermined value). On the other hand, the optical sensor 113 outputs a high level signal on the condition that the light output from the light emitter is received by the light receiver (that is, a received light intensity is equal to or larger than a predetermined value).

<Lock Shaft 145>

As illustrated in FIG. 3, a lock shaft 145 is also provided at the cartridge case 101. The lock shaft 145 extends in the left-right direction at a position near the top wall and the opening 112 of the cartridge case 101. The lock shaft 145 is a rod-like member extending in the left-right direction. For example, the lock shaft 145 is a columnar-shaped metal. The lock shaft 145 has both ends that are fixed to walls defining both ends of the cartridge case 101 in the left-right direction. Accordingly, the lock shaft 145 is not movable (for example, is not pivotable) relative to the cartridge case 101. The lock shaft 145 extends in the left-right direction across the four insertion spaces respectively corresponding to the four ink cartridges 30. In each of the insertion spaces, a space is provided around the lock shaft 145. Thus, a locking surface 151 (described later) of each ink cartridge 30 can access the lock shaft 145 by moving upward or rearward.

The lock shaft 145 supports the ink cartridge 30 attached to the cartridge-attachment section 110 at the attached position. The ink cartridge 30 is inserted into the cartridge-attachment section 110 and pivoted to its use posture, so as to be engaged with the lock shaft 145. Further, the lock shaft 145 holds the ink cartridge 30 in the cartridge-attachment section 110 against the biasing forces of coil springs 78 and 98 of the ink cartridge 30. Here, the coil springs 78 and 98 push rearward the ink cartridge 30.

<Tank 103>

As illustrated in FIG. 1, each tank 103 is provided forward of the cartridge case 101 and is connected to the corresponding ink needle 102. The tank 103 has a box-like shape that allows ink to be stored therein. An atmosphere communication port 124 is formed at an upper portion of each tank 103 so that the tank 103 can be opened to the atmosphere through the atmosphere communication port 124. The atmosphere communication port 124 is an example of a second atmosphere communication port. The tank 103 has an inner space that communicates with the inner space of the ink needle 102. With this structure, ink can flow out from the ink cartridge 30 through the ink needle 102 and is stored in the tank 103. Each tank 103 is also connected to the corresponding ink tube 20. Thus, the ink stored in the inner space of each tank 103 is supplied to the recording head 21 through the corresponding ink tube 20.

<Ink Cartridge 30>

Figure 4:
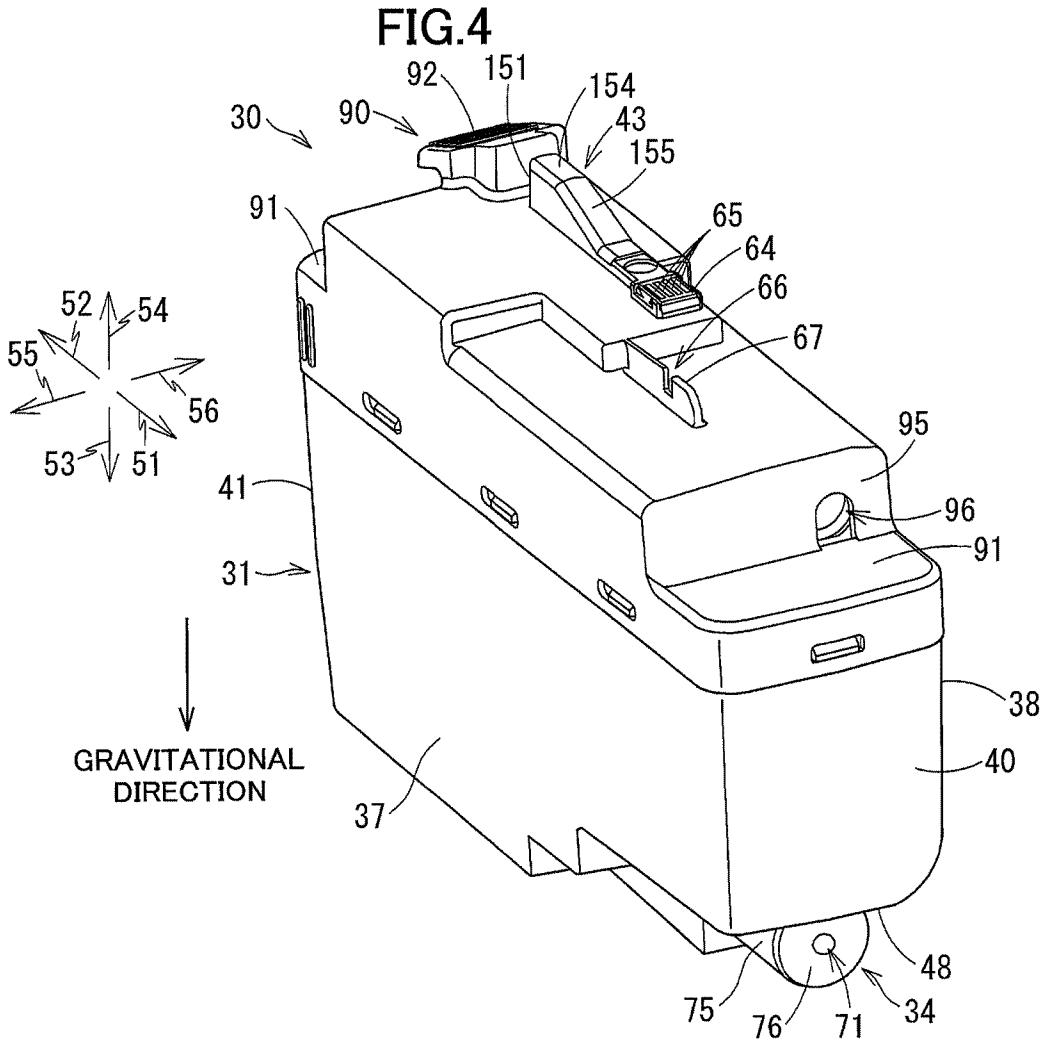
FIG. 4 is a perspective view of the ink cartridge according to the embodiment when viewed from a perspective frontward and upward thereof.
Figure 5:
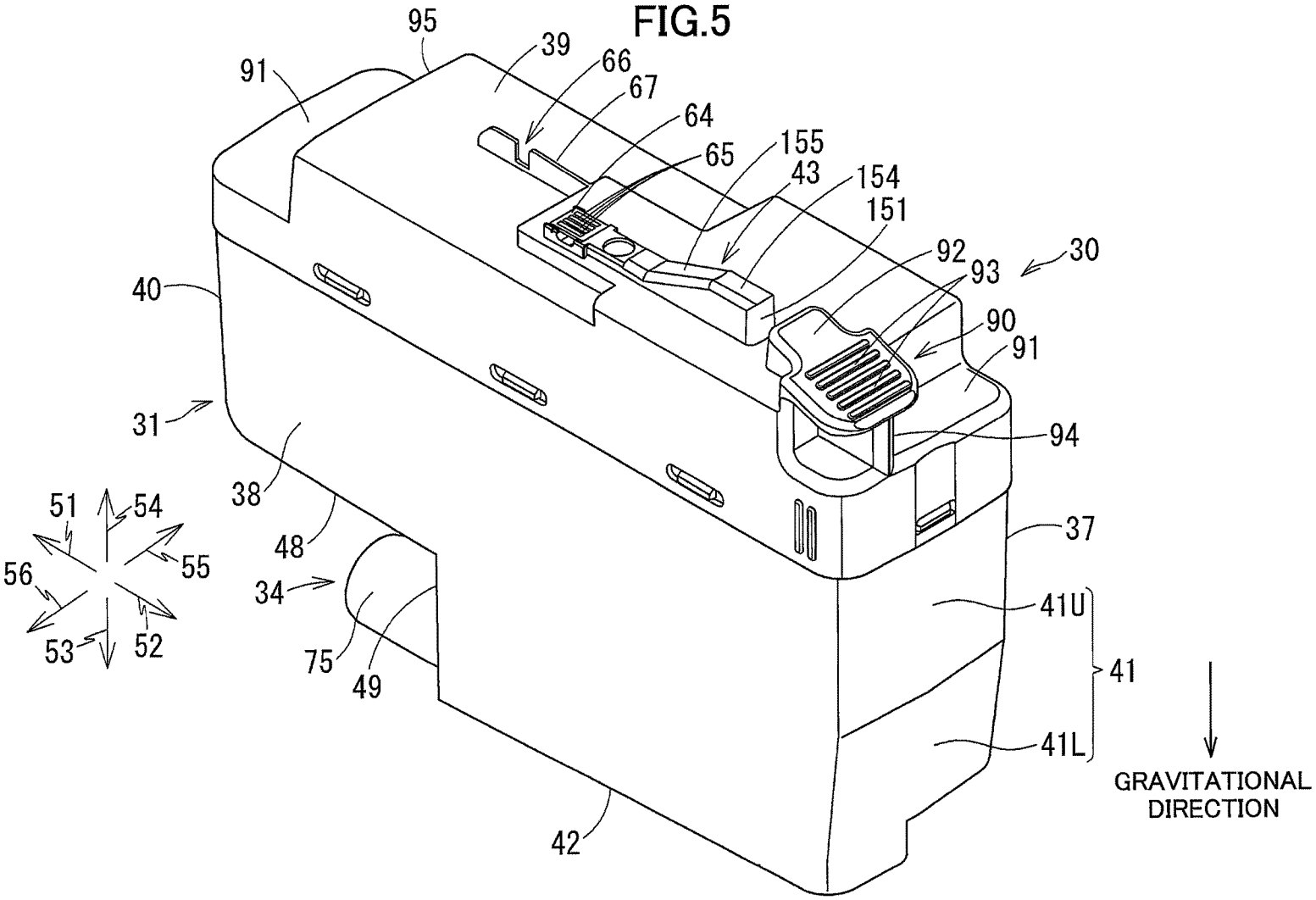
FIG. 5 is a perspective view of the ink cartridge according to the embodiment when viewed from a perspective rearward and upward thereof.
Figure 6B:
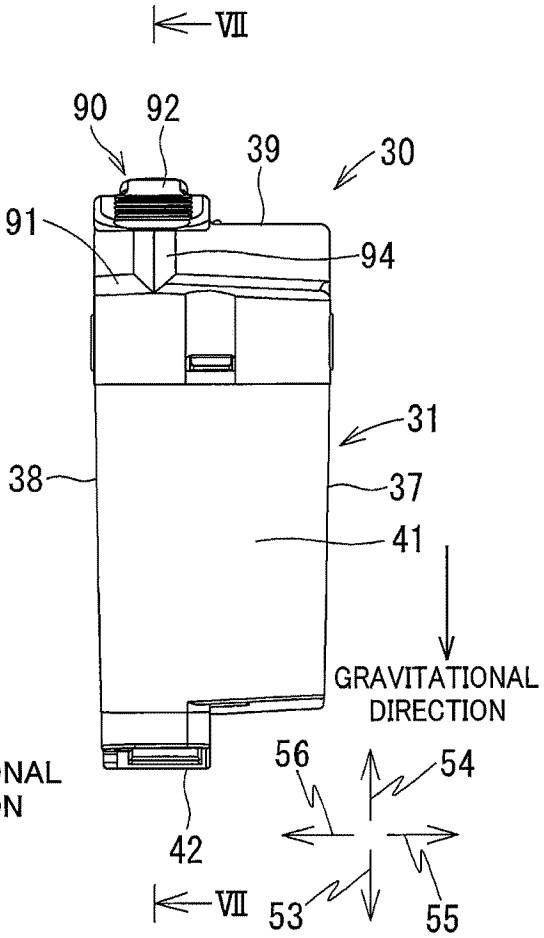
FIG. 6B is a rear side view of the ink cartridge according to the embodiment.

The ink cartridge 30 illustrated in FIGS. 4 to 6 is a container storing ink which is liquid. The ink cartridge 30 illustrated in FIGS. 4 to 6 assumes a posture when it is attached to the cartridge-attachment section 110, i.e., the use posture. As described later, the ink cartridge 30 has a front wall 40, a rear wall 41, an upper wall 39, and a lower wall 42. In the use posture, a direction from the rear wall 41 to the front wall 40 coincides with the frontward direction 51, a direction from the front wall 40 to the rear wall 41 coincides with the rearward direction 52, a direction from the upper wall 39 to the lower wall 42 coincides with the downward direction 53, a direction from the lower wall 42 to the upper wall 39 coincides with the upward direction 54, a direction from a side wall 38 to a side wall 37 coincides with the rightward direction 55, and a direction from the side wall 37 to the side wall 38 coincides with the leftward direction 56. Further, in a state where the ink cartridge 30 is attached to the cartridge-attachment section 110, the outer surface of the front wall 40 faces frontward, the outer surface of the rear wall 41 faces rearward, the outer surface of the lower wall 42 faces downward, and the outer surface of the upper wall 39 faces upward.

As illustrated in FIGS. 4 to 6, the ink cartridge 30 has a cartridge body 31 of a substantially rectangular parallelepiped shape. A first storage chamber 32 and a second storage chamber 33 are formed inside the cartridge body 31. The cartridge body 31 has a flat shape having a comparatively small width in the left-right dimension. That is, the height in the up-down direction and the depth in the front-rear direction of the cartridge body 31 are larger than the width in the left-right direction. Surfaces of the cartridge body 31 that face frontward and rearward in a state where the ink cartridge 30 is attached to the cartridge-attachment section 110, i.e., in the use posture or the upright posture, are the front wall 40 and rear wall 41, respectively. The front wall 40 and rear wall 41 are positioned away from each other in the front-rear direction. The side walls 37 and 38 extend, crossing the front wall 40 and rear wall 41, to connect the front and rear walls 40 and 41. In the use posture or the upright posture, the outer surface of the side wall 37 faces rightward, and the outer surface of the side wall 38 faces leftward. In the cartridge body 31, at least the rear wall 41 has translucency allowing the liquid surface of ink stored in the first and second storage chambers 32 and 33 to be visible from outside.

As illustrated in FIG. 5, the rear wall 41 has an upper portion 41U and a lower portion 41L. The upper portion 41U is positioned upward of the lower portion 41L. A part of the lower portion of the lower portion 41L is positioned frontward of the upper portion 41U. The upper and lower parts 41U and 41L are flat surfaces and cross each other, not orthogonally. The lower portion 41L is inclined relative to the up-down direction so as to be closer to the front wall 40 as it approaches the lower wall 42.

Figure 6A:
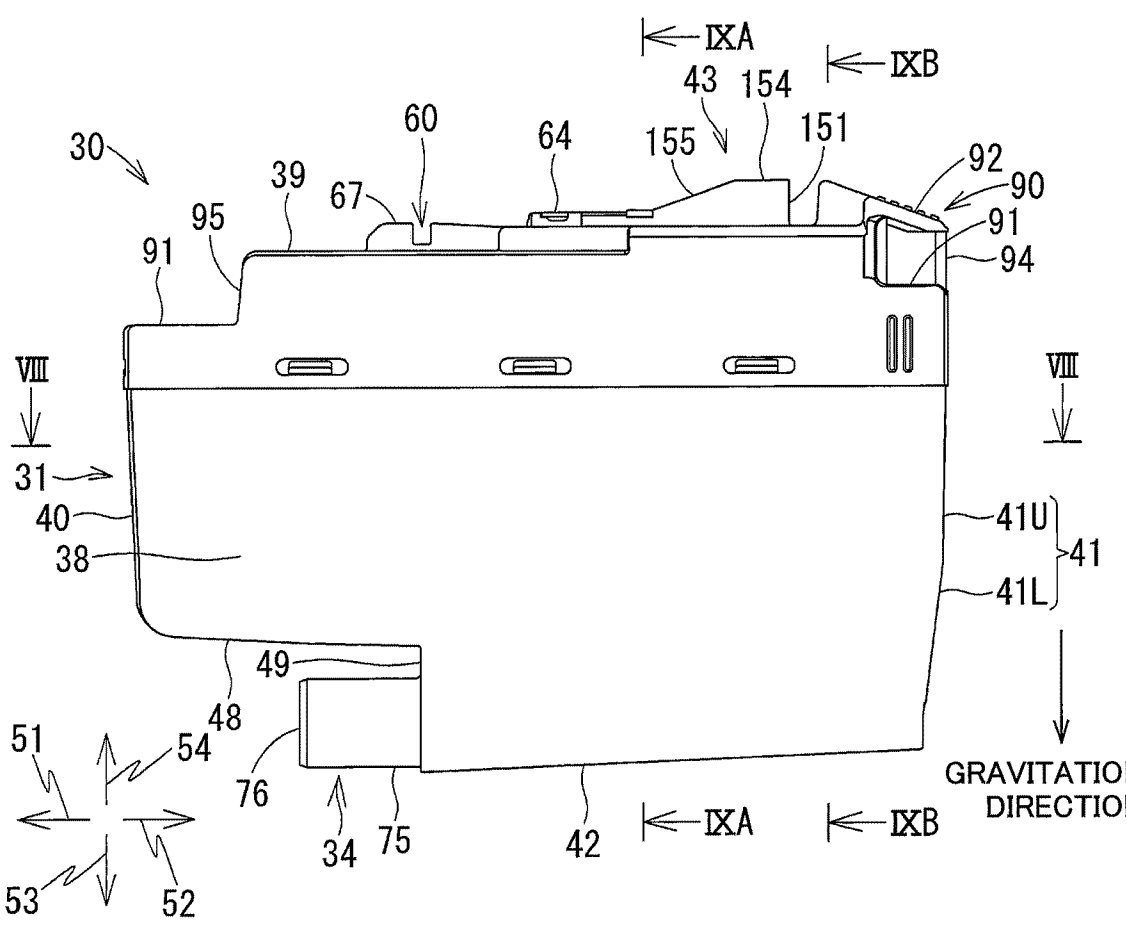
FIG. 6A is a left side view of the ink cartridge according to the embodiment.

As illustrated in FIG. 6A, the lower wall 42 is inclined relative to the front-rear direction such that the front end portion is positioned downward of the rear end portion. The front end portion of the lower wall 42 is positioned frontward of a locking surface 151 to be described later. The rear end portion of the lower wall 42 is connected to the lower end portion of the lower portion 41L of the rear wall 41.

As illustrated in FIG. 6A, the cartridge body 31 has a sub-lower wall 48 which is positioned upward of the lower wall 42 and extends rearward continuously connected to the lower end portion of the front wall 40. The rear end portion of the sub-lower wall 48 is positioned rearward of the front end portion of the ink supply portion 34. Both of the lower wall 42 and sub-lower wall 48 are connected to the stepped surface 49. The stepped surface 49 extends upward from the front end portion of the lower wall 42 and downward from the rear end portion of the sub-lower wall 48. The ink supply portion 34 extends frontward from the stepped surface 49 at a position downward of the sub-lower wall 48 and upward of the lower wall 42.

As illustrated in FIGS. 4 to 6, a protrusion 43 is provided on the upper wall 39 of the cartridge body 31. The protrusion 43 extends in the front-rear direction at a position offset leftward from the center of the upper wall 39 in the left-right direction. A surface that faces rearward and downward at the rear end portion of the protrusion 43 is the locking surface 151. The locking surface 151 is positioned upward of the upper surface 39 of the cartridge body 31. The locking surface 151 extends in the up-down direction. In a state where the ink cartridge 30 is set in the cartridge-attachment section 110, the locking surface 151 and the lock shaft 145 contact each other in the front-rear direction. The contact between the locking surface 151 and the lock shaft 145 in the front-rear direction allows the ink cartridge 30 to be held at the cartridge-attachment section 110 against the biasing force of the coil spring 78.

In the protrusion 43, a horizontal surface 154 is provided frontward of the locking surface 151, and is continuously connected to the locking surface 151. The horizontal surface 154 extends in the left-right direction and front-rear direction. An inclined surface 155 is positioned frontward of the horizontal surface 154 so as to be continuously connected to the horizontal surface 154. The inclined surface 155 faces upward and frontward. The inclined surface 155 is inclined such that the front end portion thereof is positioned downward of the rear end portion thereof. The locking surface 151 and inclined surface 155 are continuously connected to each other through the horizontal surface 154, so that a boundary edge between the locking surface 151 and the inclined surface 155 does not constitute a ridge-like shape. In the process of insertion of the ink cartridge 30 by way of the inclined surface 155 and horizontal surface 154 into the cartridge-attachment section 110, the lock shaft 145 is smoothly guided to the rear side of the locking surface 151 while abutting against the inclined surface 155 and horizontal surface 154.

An operation portion 90 is formed on the upper wall 39 of the cartridge body 31 at a position rearward of the locking surface 151. Sub-upper surfaces 91 (front-side sub-upper surface and rear-side sub-upper surface) are formed frontward of and rearward of the upper wall 39 of the cartridge body 31, respectively, so as to be positioned downward of the outer surface positioned at the center portion of the upper wall 39 in the front-rear direction. The operation portion 90 is disposed upward of the rear-side sub-upper surface 91 with a space therebetween. The operation portion 90 has a plate-like shape and protrudes upward from the boundary between the upper wall 39 and the rear-side sub-upper surface 91 to the same level as the protrusion 43. The upper end portion of the operation portion 90 is positioned frontward of the lower end portion thereof. A rib 94 is formed between the operation portion 90 and rear-side sub-upper surface 91 so as to continue from the operation portion 90 and the rear-side sub-upper surface 91 and extend rearward. The dimension of the rib 94 in the left-right direction is smaller than those of the operation portion 90 and rear-side sub-upper surface 91 in the left-right direction. The rear side of the operation portion 90 is suppressed from being deformed in the up-down direction by the rib 94.

A surface of the operation portion 90 that faces upward and rearward is an operation surface 92. The rear side of the operation surface 92 and the rear-side of the sub-upper surface 91 extend in the front-rear direction, and these positions overlap each other in the front-rear direction when viewed in the vertical direction. In other words, when the ink cartridge 30 is viewed downward from the upper side thereof, the rear side of the operation surface 92 and rear-side sub-upper surface 91 overlap each other. In the operation surface 92, a plurality of projections, e.g., a plurality of ridges 93 extending in the left-right direction are formed spaced apart from one another in the front-rear direction. Disposition of the ridges 93 as protrusions allows the user to easily visually recognize the operation surface 92 and prevents the user's finger from slipping on the operation surface 92 when the user operates the operation surface 92 with his or her finger.

The operation surface 92 can be visible when the ink cartridge 30 is viewed downward from the upper side thereof and frontward from the rear side thereof. The operation surface 92 is a surface for the user to operate to remove the ink cartridge 30 from the cartridge-attachment section 110. The operation portion 90 and the cartridge body 31 are integrally formed. Thus, the operation portion 90 is fixed to the cartridge body 31 and is thus not moved (pivoted, for example) relative to the cartridge body 31. Thus, force applied from the user to the operation surface 92 is directly transmitted to the cartridge body 31 without changing the direction.

The outer surfaces of the respective front wall 40, rear wall 41, upper wall 39, lower wall 42, and side walls 37, 38 of the ink cartridge 30 need not necessarily constitute one plane. That is, surfaces that can be visually recognized when the ink cartridge 30 assuming the use posture is viewed rearward from the front side thereof and positioned frontward of the center of the ink cartridge 30 in the use posture in the front-rear direction is the outer surface of the front wall 40. Surfaces that can be visually recognized when the ink cartridge 30 in the use posture or the upright posture is viewed frontward from the rear side thereof and positioned rearward of the front-rear center portion of the ink cartridge 30 are the outer surfaces of the rear wall 41. Surfaces that can be visually recognized when the ink cartridge 30 in the use posture or the upright posture is viewed downward from the upper side thereof and positioned upward of the up-down center portion of the ink cartridge 30 are the outer surfaces of the upper wall 39. Surfaces that can be visually recognized when the ink cartridge 30 in the use posture or the upright posture is viewed upward from the lower side thereof and positioned downward of the up-down center portion of the ink cartridge 30 are the outer surfaces of the lower wall 42. The same can be said for the outer surfaces of the respective side walls 37 and 38.

As illustrated in FIGS. 4 to 6, the light-blocking plate 67 protrudes upward from the outer surface of the upper wall 39. The light-blocking plate 67 extends in the front-rear direction. The light-blocking plate 67 is positioned frontward of the protrusion 43. The light-blocking plate 67 is positioned frontward of an IC board 64 to be described later.

The light-blocking plate 67 shields the light of the optical sensor 113 that travels in the left-right direction. More specifically, when the light emitted or irradiated from the light emitter of the optical sensor 113 hits the light-blocking plate 67 before it reaches the light receiver, the intensity of the light that reaches the light receiver is reduced to less than a predetermined intensity, e.g., zero. The light-blocking plate 67 may completely shield light traveling in the left-right direction, may partially attenuate light, may bend the traveling direction of light, or may totally reflect light. A cutout 66 is formed in the light-blocking plate 67. The cutout 66 is a space recessed downward from the upper end portion of the light-blocking plate 67 and extends in the front-rear direction. The cutout 66 is positioned corresponding to the optical sensor 113, so that light emitted from the light emitter of the optical sensor 113 is not shielded before it reaches the light receiver. The type of the ink cartridge 30, i.e., the type of or the initial amount of the ink stored in the ink cartridge 30 can be determined by the user of the printer 10 or the printer 10 depending on the presence or absence of the cutout 66.

As illustrated in FIGS. 4 to 6, the IC board 64 is provided on the outer surface of the upper wall 39 and between the light-blocking plate 67 and the protrusion 43. The IC board 64 is electrically connected to the four contacts 106 in a process that the ink cartridge 30 is attached to the cartridge-attachment section 110 and in a state where the ink cartridge 30 is attached to the cartridge-attachment section 110.

The IC board 64 has a substrate, an IC (not illustrated), and four electrodes 65. The substrate supports the IC. The four electrodes 65 are formed on the substrate. The four electrodes 65 and the IC are electrically connected to each other. Each of the four electrodes 65 extends in the front-rear direction, and is arranged in the left-right direction. The four electrodes 65 are exposed to the upper surface of the IC board 64 so as to be electrically accessible. This allows each of the four contacts 106 of the cartridge case 101 and each of the four electrodes 65 to be brought into direct contact with each other. The IC is an integrated circuit and readably stores data indicating information concerning the ink cartridge 30, including, e.g., a lot number, a manufacturing date, and an ink color. The substrate may be a so-called rigid substrate, or a flexible substrate having flexibility.

A stepped surface 95 extends upward from the rear end portion of the front-side sub-upper surface 91. The stepped surface 95 faces frontward. In the process of attachment of the ink cartridge 30 to the cartridge-attachment section 110, the rod 125 enters the atmosphere communication port 96. The rod 125 entering the atmosphere communication port 96 moves a valve 97 backward that seals the atmosphere communication port 96 against the biasing force of the coil spring 98. Then, the valve 97 moved backward is separated from the atmosphere communication port 96, whereby the first storage chamber 32 is opened to the atmosphere.

<Internal Configuration of Housing 31>

Figure 7:
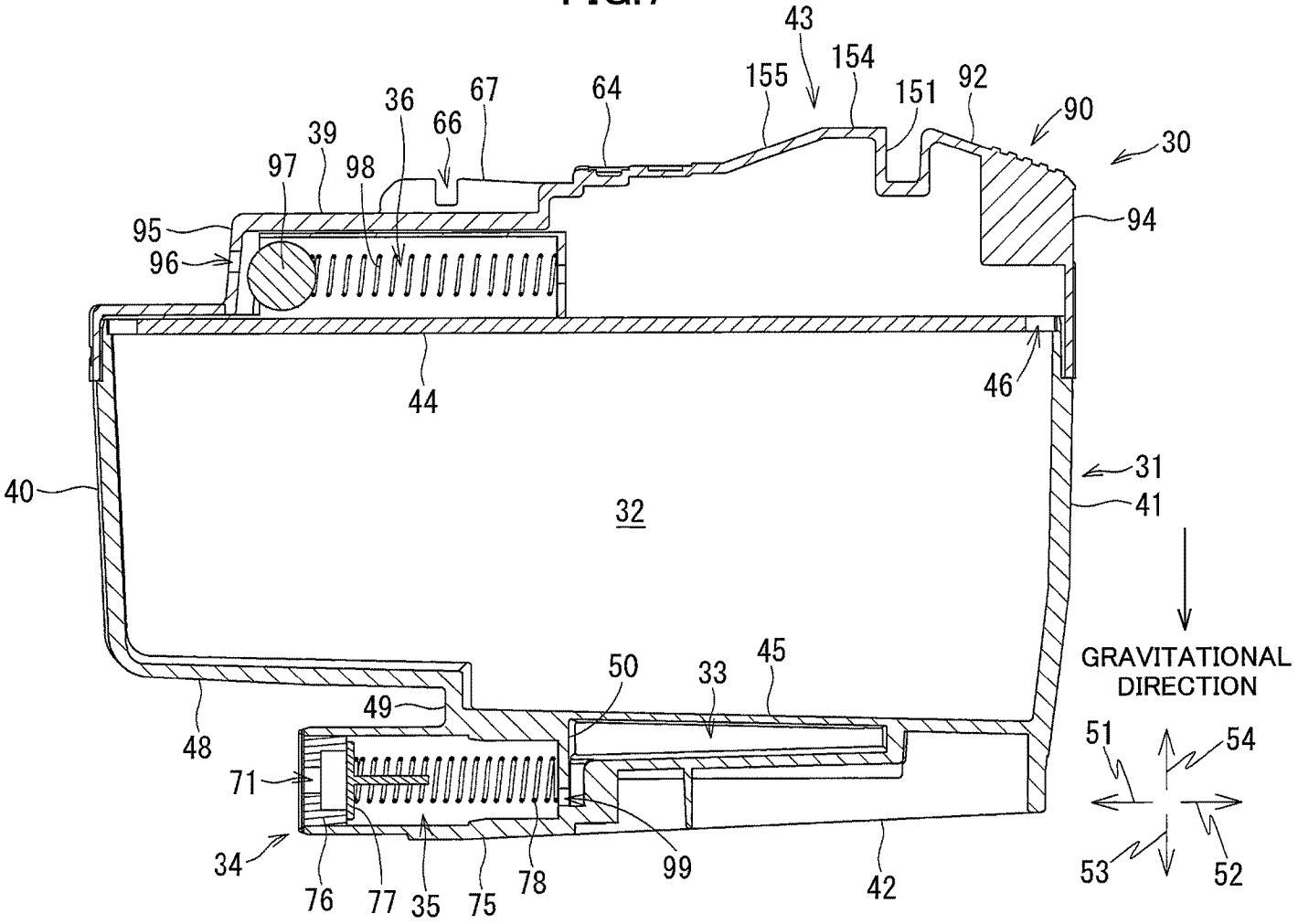
FIG. 7 is a cross-sectional view of the ink cartridge according to the embodiment taken along a line VII-VII illustrated in FIG. 6B.

As illustrated in FIG. 7, the first storage chamber 32, second storage chamber 33, an ink valve chamber 35 (an example of a liquid flow path), and an atmospheric valve chamber 36 are formed inside the cartridge body 31. Further, the cartridge body 31 has inside thereof a partitioning wall 44, and a bottom wall 45. The partitioning wall 44 separates the first storage chamber 32 and atmospheric valve chamber 36. The bottom wall 45 separates the first and second storage chambers 32 and 33. Each of the partitioning wall 44 and bottom wall 45 extends in the front-rear direction and left-right direction. The partitioning wall 44 and bottom wall 45 are disposed opposite to each other in the up-down direction.

The upper end portion of the first storage chamber 32 is defined by the lower surface of the partitioning wall 44, and the lower end portion of the first storage chamber 32 is defined by the upper surface of the bottom wall 45. The front end portion of the first storage chamber 32 is defined by the inner surface of the front wall 40, and the rear end portion of the first storage chamber 32 is defined by the inner surface of the rear wall 41. Both the side ends of the first storage chamber 32 are defined by the inner surfaces of the respective side walls 37 and 38. That is, the first storage chamber 32 is a space defined by the lower surface of the partitioning wall 44, upper surface of the bottom wall 45, inner surface of the front wall 40, inner surface of the rear wall 41, and inner surfaces of the side walls 37 and 38. At the time of manufacturing of the ink cartridge 30, ink stored in the first storage chamber 32 contacts the inner surface of the sub-lower wall 48, upper surface of the bottom wall 45, inner surface of the front wall 40, inner surface of the rear wall 41, and inner surfaces of the side walls 37 and 38. A through hole 46 is formed in the partitioning wall 44. The first storage chamber 32 and atmospheric valve chamber 36 are in communication with each other through the through hole 46.

In the inner space of the cartridge body 31, the second storage chamber 33 stores ink, and is positioned downward of the first storage chamber 32 in the use posture. The capacity of the second storage chamber 33 for storing ink is smaller than that of the first storage chamber 32.

The upper end portion of the second storage chamber 33 is defined by the lower surface of the bottom wall 45 and the lower end portion thereof by the upper surface of the lower wall 42. The rear end portion of the second storage chamber 33 is defined by the inner surface of the rear wall 41. Both the side ends of the second storage chamber 33 are defined by the inner surfaces of the side walls 37 and 38. A partition wall 50 is formed between the second storage chamber 33 and the ink valve chamber 35. The front end portion of the second storage chamber 33 is defined by a part of the surface of the partition wall 50 that is close to the second storage chamber 33. That is, the second storage chamber 33 is a space defined by the lower surface of the bottom wall 45, upper surface of the lower wall 42, inner surface of the rear wall 41, inner surfaces of the respective side walls 37 and 38, and the inner surface of the partition wall 50. Incidentally, at the time of shipment of the ink cartridge 30, ink stored in the second storage chamber 33 contacts the lower surface of the bottom wall 45, the upper surface of the bottom wall 42, the inner surface of the rear wall 41, the inner surfaces of the side walls 37 and 38, and the surface of the partitioning wall 50 that defines the second storage chamber 33. The second storage chamber 33 is in communication with the first storage chamber 32 through a communication port 47 formed in the bottom wall 45. The second storage chamber 33 is in communication with the ink valve chamber 35 through a through hole 99 formed in the partition wall 50. The communication port 47 is an example of a communication port opening.

The valve 97 and coil spring 98 are housed in the atmospheric valve chamber 36. The atmospheric valve chamber 36 communicates with the atmosphere through the atmosphere communication port 96 formed in the stepped surface 95. The valve 97 is movable between a closing position where the valve 97 seals the atmosphere communication port 96 and an opening position where the valve 97 is separated from the atmosphere communication port 96. The coil spring 98 is disposed so as to be expandable or contractible in the front-rear direction and biases the valve 97 in a direction in which the valve 97 abuts against the atmosphere communication port 96, i.e., in the frontward direction 51.

The ink supply portion 34 has a cylindrical outer shape. More specifically, the ink supply portion 34 has a packing 76 and a cylinder 75 that has an open front end portion. The cylinder 75 protrudes frontward from the stepped surface 49. The inner space of the cylinder 75 serves as the ink valve chamber 35. The front end portion of the cylinder 75 has an opening opened to the outside of the ink cartridge 30. The packing 76 is positioned at the front end portion of the cylinder 75.

A valve 77 and a coil spring 78 are housed in the ink valve chamber 35. The valve 77 is moved in the front-rear direction to open and close the ink supply port 71 penetrating the center of the packing 76. The coil spring 78 biases the valve 77 forward. Accordingly, in a state where external force is not applied, the valve 77 closes the ink supply port 71 of the packing 76.

The packing 76 is a disk-shaped member having a through hole at the center portion thereof. The packing 76 is made from an elastic material such as rubber or elastomer. A tubular inner peripheral surface is formed so as to penetrate the center portion of the packing 76 in the front-rear direction. By the tubular inner peripheral surface, the ink supply port 71 is formed. The inner diameter of the ink supply port 71 is slightly smaller than the outer diameter of the ink needle 102.

When the ink cartridge 30 is inserted into the cartridge-attachment section 110 in a state where the valve 77 closes the ink supply port 71, the ink needle 102 enters the ink supply port 71. The ink needle 102 elastically deforms the packing 76, and the outer peripheral surface thereof liquid-tightly contacts the inner peripheral surface, which defines the ink supply port 71. When the leading end portion of the ink needle 102 passes through the ink supply port 71 formed in the packing 76 and enters the ink valve chamber 35, it abuts against the valve 77. When the ink cartridge 30 is further inserted into the cartridge-attachment section 110, the ink needle 102 moves the valve 77 rearward against the biasing force of the coil spring 78. This allows ink stored in the valve chamber 35 to flow into the inner space of the ink needle 102.

<Communication Port 47>

Figure 8A:
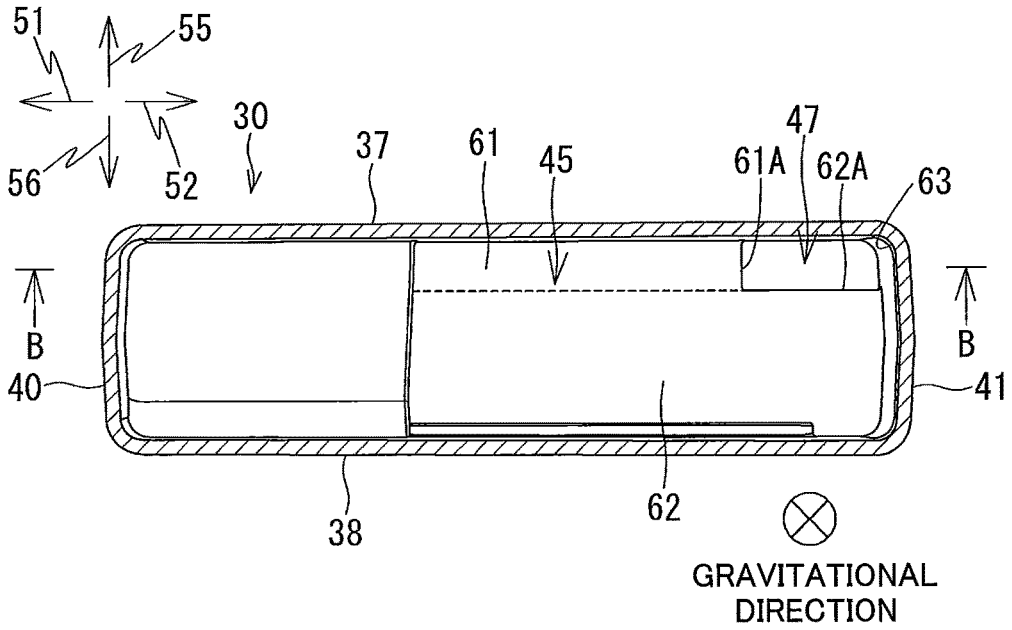
FIG. 8A is a cross-sectional view of the ink cartridge according to the embodiment taken along a line VIII-VIII illustrated in FIG. 6A.
Figure 8B:
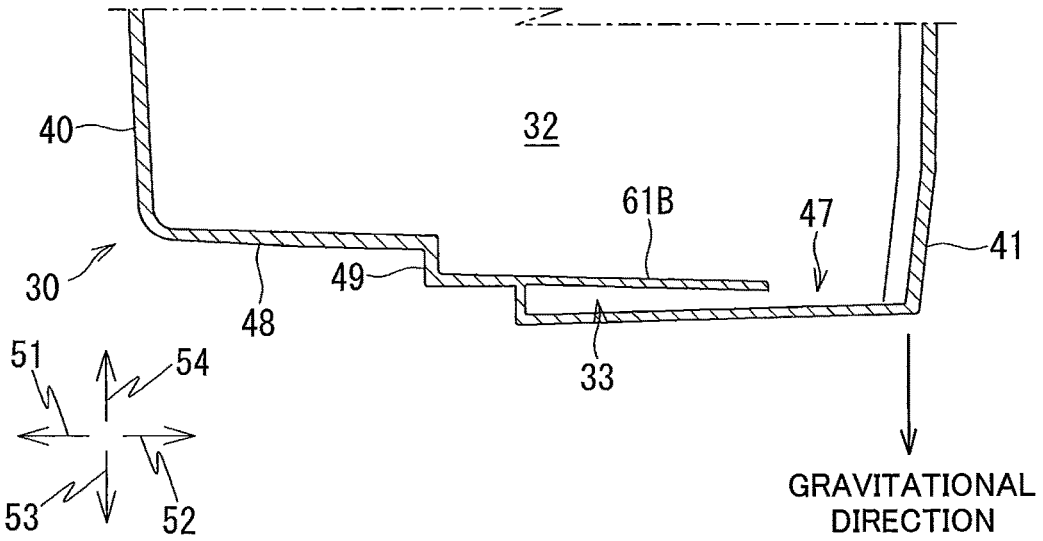
FIG. 8B is a cross-sectional view of the ink cartridge according to the embodiment taken along a line B-B illustrated in FIG. 8A.

As illustrated in FIGS. 8A and 8B, in the use posture of the ink cartridge 30, the communication port 47 is disposed adjacent to the end portion in the left-right direction of the inner surface of the rear wall 41 in the cartridge body 31. The communication port 47 is defined by the inner surface of the rear wall 41, inner surface of the side wall 37, and the end surface (rear end surface 61A and side end surface 62A) of the bottom wall 45. Specifically, the bottom wall 45 has the rear end surface 61A and side end surface 62A. As illustrated in FIG. 8A, the bottom wall has a first portion 61 and a second portion 62, which are the portions adjacent to each other in the left-right direction.

The rear end surface 61A is separated away rearward from the inner surface of the rear wall 41. That is, the first portion 61 is not continuous to the rear wall 41. The side end surface 62A is positioned rear end portion of the second portion 62 and is separated away from the inner surface of the side wall 37. The rear end surface 61A and side end surface 62A cross each other. Except for the rear end surface 61A and the side end surface 62A, the first portion 61 and the second portion 62 forms a continuance of the upper surface and a continuance of the lower surface. The rear end surface 61A and the side end surface 62A each connect the upper surface and the lower surface of the bottom wall 45.

The end surface of the bottom wall 45 that defines the communication port 47 is the rear end surface 61A of the first portion 61 and the side end surface 62A of the second portion 62. The inner surface of the rear wall 41 and the inner surface of the side wall 37 are connected by a connecting portion 63 having a curved surface. Accordingly, the communication port 47 has a rectangular shape when viewed in the vertical direction in the use posture and has a curved corner formed by the inner surfaces of the rear wall 41 and side walls 37.

Figure 9B:
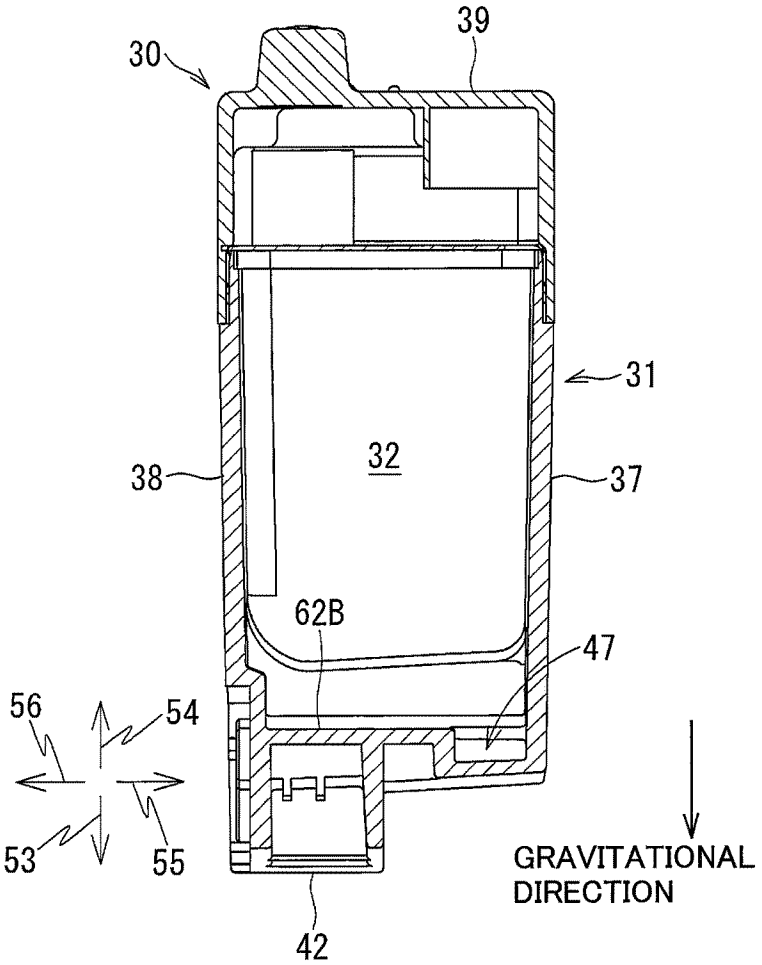
FIG. 9B is a cross-sectional view of the ink cartridge according to the embodiment taken along a line IXB-IXB illustrated in FIG. 6A.
Figure 9A:
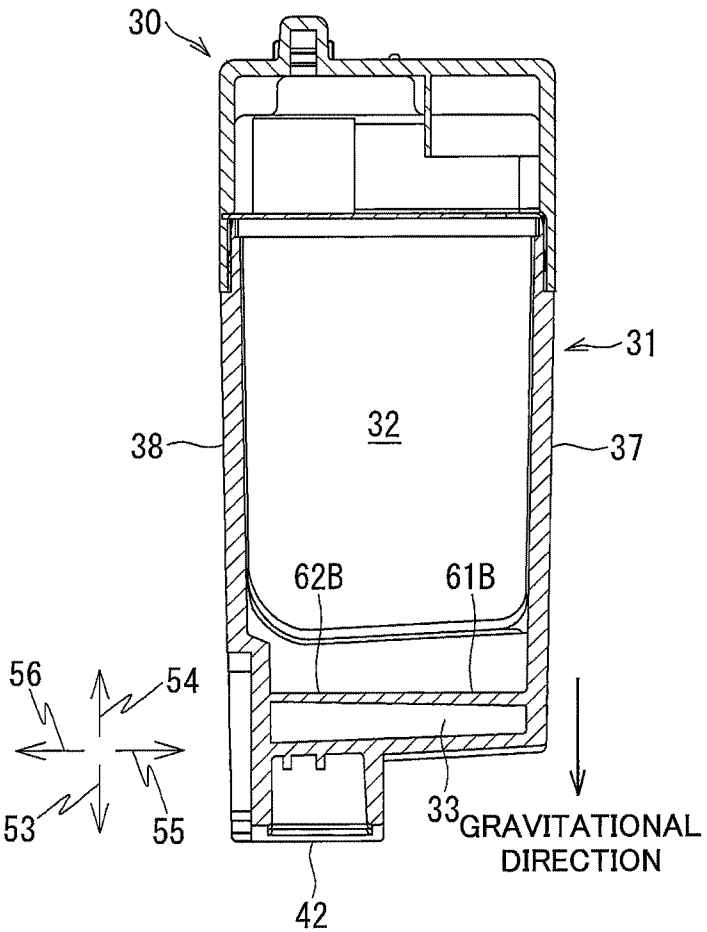
FIG. 9A is a cross-sectional view of the ink cartridge according to the embodiment taken along a line IXA-IXA illustrated in FIG. 6A.

As illustrated in FIG. 9B, in the use posture of the second portion 62 of the bottom wall 45, the surface 62B partitioning the first storage chamber 32 is inclined toward the communication port 47 in the left-right direction. That is, the right end portion of the surface 62B is positioned downward relative to the left end portion thereof. Further, the surface 61B and the surface 62B of the bottom wall 45 is inclined toward the communication port 47 in the front-rear direction in the use posture. Namely, the front end portion of the bottom wall 45 is positioned upward relative to the rear end portion thereof, as illustrated in FIG 8B.

<Rotated Posture>

Figure 10:
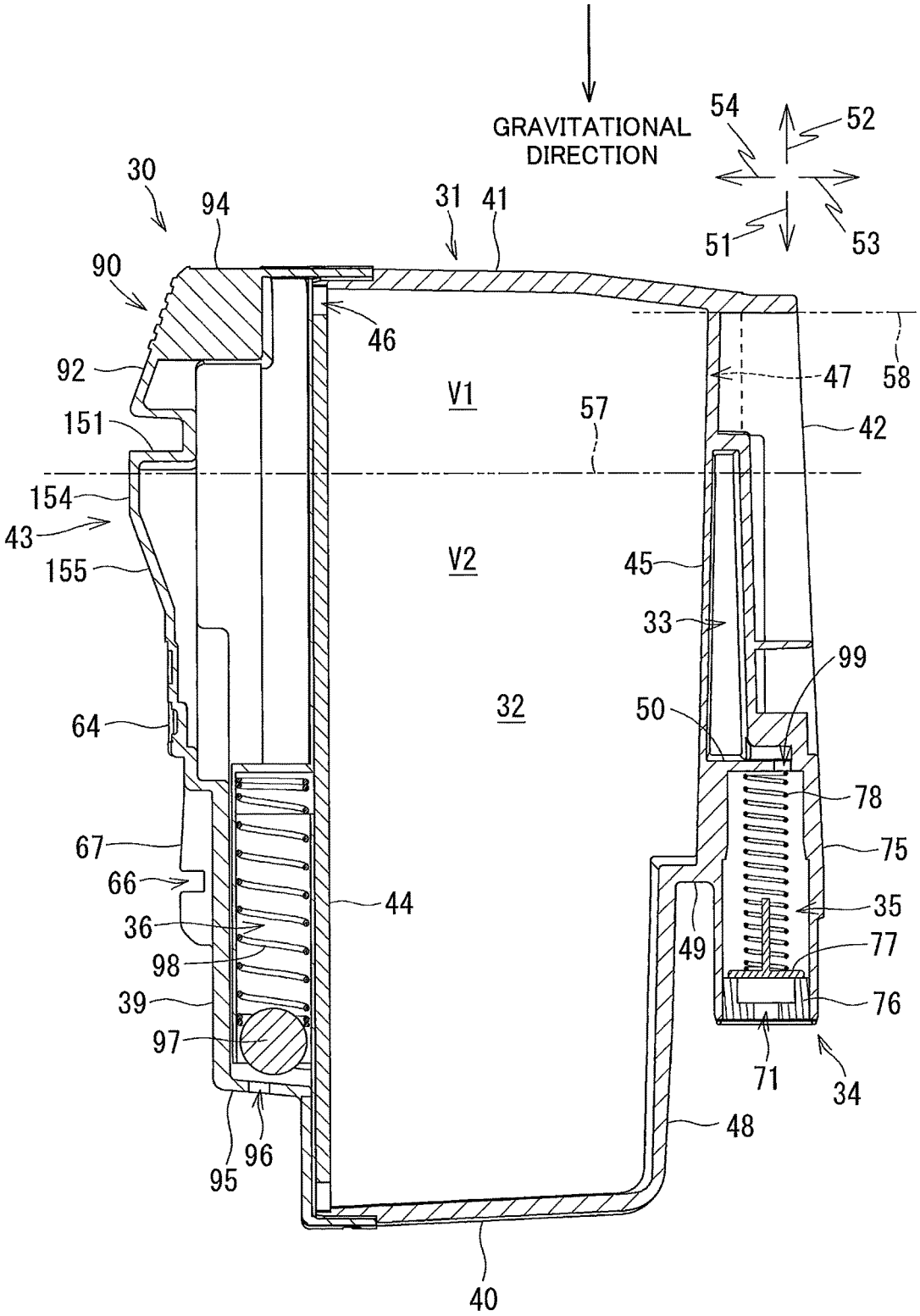
FIG. 10 is a cross-sectional view of the ink cartridge in a rotated posture according to the embodiment taken along the line VII-VII.

In the use posture where the ink cartridge 30 is attached to the cartridge-attachment section 110 and the printer 10 is used, the front wall 40 and the rear wall 41 extend in the substantially gravitational direction and positioned separated from each other in the substantially horizontal direction. On the other hand, as illustrated in FIG. 10, the printer 10 alone or with attached to the cartridge-attachment section 110 is set in a rotated posture where the rear wall 41 and the front wall 40 that is positioned downward of the rear wall 41 face in the gravitational direction. For example, the ink cartridge 30 is supposed to be set in the rotated direction when the printer 10 is packed or shipped in a state where the ink cartridge 30 is attached to the cartridge-attachment section 110.

As illustrated in FIG. 10, the ink supply port 71 of the ink cartridge 30 in the rotated posture opens toward the gravitational direction, i.e. the downward direction. The first storage chamber 32 and the second storage chamber 33 are arranged in the horizontal direction, so that the bottom wall 45 is positioned between the first storage chamber 32 and the second storage chamber 33. In the rotated posture, the ink cartridge 30 defines an imaginary horizontal plane 57 that crosses the communication port 47 and passes through the lower end portion of the communication port 47, i.e. the rear end surface 61A of the first portion 61 in the bottom wall 45. The imaginary horizontal plane 57 defines a first capacity V1 and a second capacity V2 in the first storage chamber 32. Here, the first capacity V1 is defined as the capacity above the imaginary horizontal plane 57 in the first storage chamber 32 and the second capacity V2 defined as the capacity below the imaginary horizontal plane 57 in the first storage chamber 32. The first capacity V1 is less than the second capacity V2 (V1<V2). As illustrated in FIG. 10, the ink cartridge 30 further defines an imaginary horizontal plane 58 that crosses the communication port 47 and passes through the upper end portion of the communication port 47. The communication port 47 penetrates the bottom wall 45 between the imaginary horizontal planes 57 and 58 in the downward and upward directions 53 and 54. The upper end portion of the communication port 47 in the rotated posture is an example of a first end portion, and the lower end portion of the communication port 47 in the rotated posture is an example of a second end portion. The rear end surface 61A is also the second end portion.

The ink valve chamber 35 is positioned downward relative to the imaginary horizontal plane 57 in the rotated posture. The gravitational force exerting on the ink in the second storage chamber 33 can cause the ink to flow into the ink valve chamber 35 so that the ink flows out of the ink supply port 71. Accordingly, when the ink surface in the first storage chamber 32 is above the imaginary horizontal plane 57 in the rotated posture, the ink can flow into the second storage chamber 33 and further into the ink valve chamber 35. Assuming that the ink amount stored in the first storage chamber 32 is small, the ink surface in the first storage chamber 32 is below the imaginary horizontal plane 57 even in the rotated posture. The ink stored in the first storage chamber 32 therefore cannot flow into the second storage chamber 33. The following assumes that the ink in the first storage chamber 32 flows into the second storage chamber 33 in the rotated posture and the ink surface descends below the imaginary horizontal plane 57. The bottom wall 45 divides the inner space of the ink cartridge 30 into the first storage chamber 32 and the second storage chamber 33, and the ink therefore cannot further flows into the second storage chamber 33. Because of the gravitational force, some amount of the ink stored in the second storage chamber 33 can flow into the ink valve chamber 35 so as to flow out of the ink cartridge 30 via the ink supply port 71. Meanwhile, the ink in the first storage chamber 32 stored below the imaginary horizontal plane 57 cannot flow out of the ink cartridge 30. Accordingly, the ink cartridge 30 reduces the amount of ink that is likely to flow out of the ink cartridge 30 in the rotated posture.

<Modifications>

In the above disclosure, the communication port 47 is positioned at the left-right corner of the inner surface of the rear wall 41. Alternatively, the disposition of the communication port 47 in the left-right direction can be changed. For example, the communication port 80 may be formed in place of the communication port 47. Specifically, as illustrated in FIG. 11A, a left-right center CL2 of the communication port 80 may be positioned offset from a left-right center CL 1 of the inner surface of the rear wall 41 in the left-right direction. The communication port 80 may be positioned offset from the left-right corners. In this case, since the communication port 80 is not formed in the whole dimension of the first storage chamber 32 in the left-right direction, the bottom wall 45 prevents the ink stored in the first storage chamber 32 from flowing out in a lying posture. Here, in the lying posture, the one side in the left-right direction of the cartridge body 31 is positioned downward and the other side is positioned upward. For example, the external surface of the side wall 38, which is the side wall farther from the communication port 80, faces in the gravitational direction in the lying posture. The inner side of side wall 37, which is the side wall closer to the communication port 80, faces the gravitational direction in the lying posture. The communication port 80 is an example of a communication port opening.

Figure 11B:
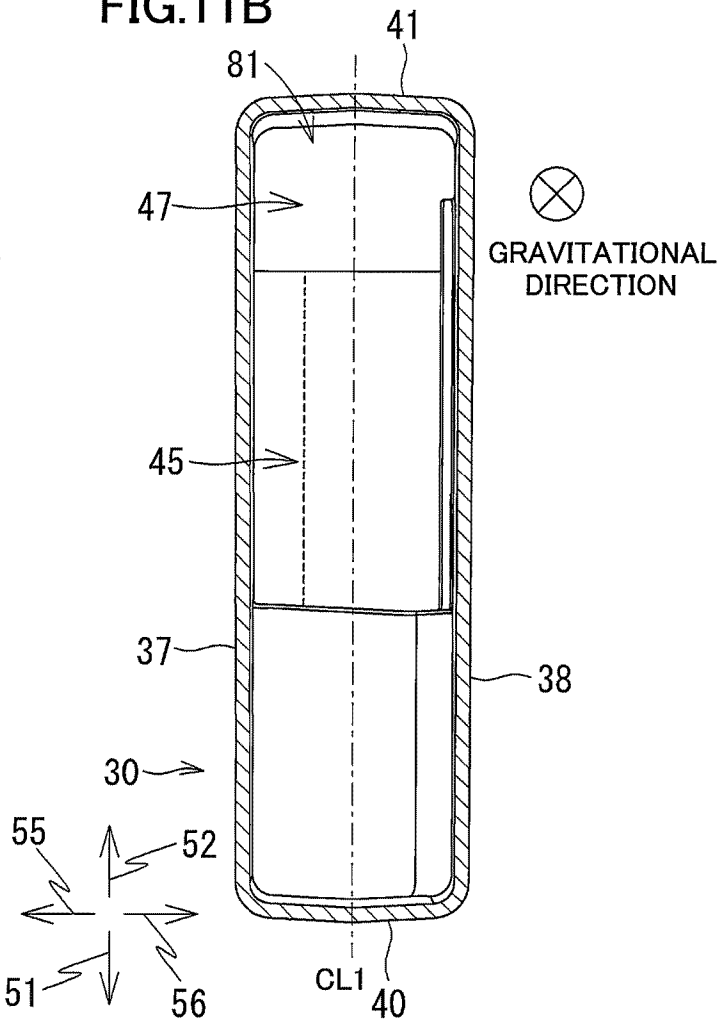
FIG. 11B is a cross-sectional view of an ink cartridge according to another modification taken along the same position of the line VIII-VIII, showing a communication port 81.
Figure 11A:
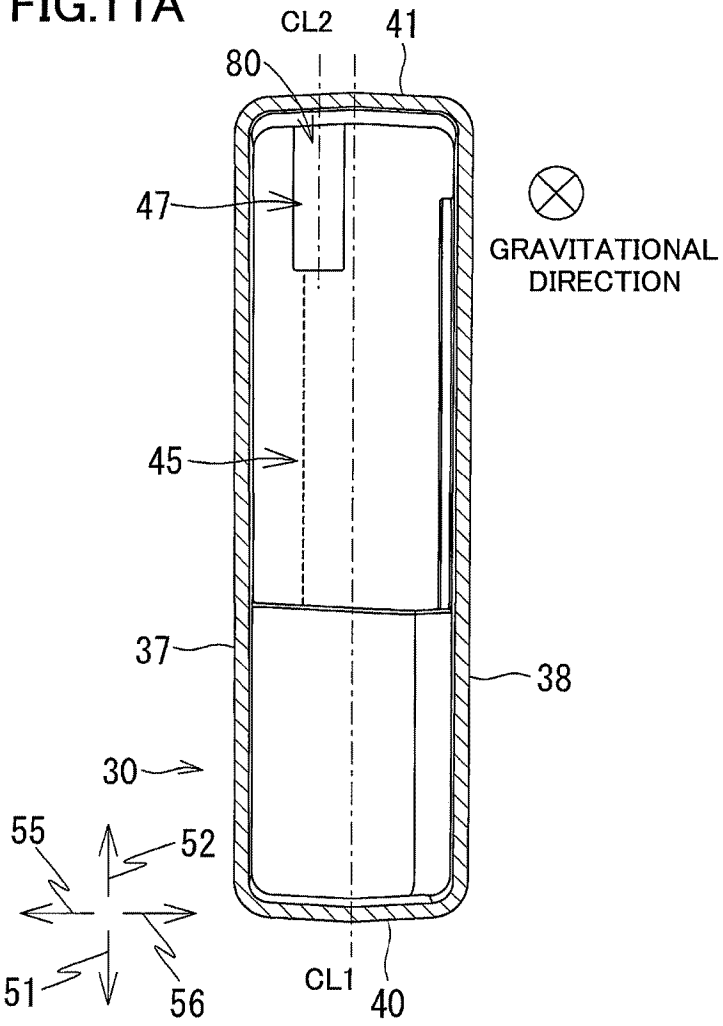
FIG. 11A is a cross-sectional view of an ink cartridge according to a modification taken along the same position of the line VIII-VIII, showing a communication port 80.

Further, as illustrated in FIG. 11B, a communication port 81 may be formed in place of the communication port 47 in the whole dimension in the left-right direction of the first storage chamber 32. In the case, the ink stored lower than the imaginary horizontal plane 57 in the first storage chamber 32 does not flow out through the ink valve chamber 35. The communication port 81 is an example of a communication port opening.

The shape of the communication port 47 is not limited to the rectangular shape. For example, the communication port 47 may have a shape such as the circular shape, the oval shape, and the polygon shape in the planner view.

Further, the ink supply port 71 may be sealed by a film in place of the respective valve 77. Further, the ink supply port 71 may be formed by piercing a needle into a seal member made of elastic resin having no through hole. In this case, when the needle is removed from the seal member, the opening is sealed by the elasticity of the seal member. Further, the ink supply portion 34 need not necessarily be a cylindrical member. For example, a through hole formed in the front wall 40 of the cartridge body 31 may be constituted as the ink supply part. In this case, the ink supply portion 34 may include the front wall 40 formed with the through hole.

Further, in the above-described embodiment, ink is used as an example of liquid; however, the present invention is not limited to this. For example, in place of ink, pretreatment liquid to be ejected, prior to ink, onto a paper sheet at printing may be stored in a liquid cartridge. Further, water for cleaning the recording head 21 may be stored in the liquid cartridge. That is, the ink cartridge 30 needs not necessarily be a cartridge to store ink, and the ink cartridge 30 may be a cartridge to store liquid consumed by the printer 10.

<Functions and Effects>

According to the ink cartridge 30 in the disclosure (referred to as an liquid cartridge), ink stored lower than the imaginary horizontal plane 57 in the first storage chamber 32 in the rotated posture does not flow outside through the ink valve chamber 35. Further, since the ink amount that the second storage chamber 33 can store is less than the ink amount that the first storage chamber 32 can store, the ink cartridge 30 reduces the amount of ink that can flow out of the ink cartridge 30 in the rotated posture. Further, the first capacity V1 of the first storage chamber 32 is less than the second capacity V2 of the first storage chamber 32. Here, the first capacity V1 is the capacity of the first storage chamber 32 upward relative to the imaginary horizontal plane 57 in the rotated posture, and the second capacity V2 is the capacity of the first storage chamber 32 downward relative to the imaginary horizontal plane 57 in the rotated posture. Accordingly, the ink cartridge 30 reduces the amount of ink that can flow out of the ink cartridge 30 in the rotated posture.

Further, the communication port 47 is defined in the cartridge body 31 by the inner surface of the rear wall 41, the rear end surface 61A of the first portion 61 of the bottom wall 45, and the side end surface 62A of the second portion 62. The communication port 47 is positioned at the left-right corner of the inner surface of the rear wall 41. Because of the disposition of the communication port 47, the communication port 47 is positioned at the uppermost portion in the first storage chamber 32. Accordingly, in the rotated posture, the bottom wall 45 prevents the ink stored lower than the imaginary horizontal plane 57 from flowing out. Accordingly, the ink cartridge 30 reduces the amount of ink that can flow out of the ink cartridge 30 in the rotated posture. Further, in the lying posture where the side wall 38 is positioned downward and the side walls 37 is positioned upward, the second portion 62 prevents the ink from flowing out. Accordingly, the ink cartridge 30 reduces the amount of ink that can flow out of the cartridge in the lying posture.

The communication port 47 in the use posture has a rectangular shape in the planner view or when viewed from upward, and the ink flowing out from the first storage chamber 32 is suppressed from remaining in the upper surface of the bottom wall 45 adjacent to the communication port 47. Further, since the rectangular shape of the communication port 47 has a curved corner, the ink flowing out of the first storage chamber 32 is suppressed from remaining in the corner of the communication port 47 in the use posture.

In the bottom wall 45, a surface 62B of the second portion 62 is inclined in the left-right direction toward the communication port 47 in the use posture. Accordingly, the ink stored in the first storage chamber 32 can be facilitated to flow into the communication port 47 in the use posture.

In the bottom wall 45, a surface 61B of the first portion 61 and the surface 62B of the second portion 62 are inclined in the front-rear direction toward the communication port 47. Accordingly, the ink stored in the first storage chamber 32 can be facilitated to flow into the communication port 47 in the use posture.

Further, the rear wall 41 has a, the rear wall 41 has translucency allowing the liquid surface of ink stored in the first and second storage chambers 32 and 33 to be visible from outside. Accordingly, the ink remaining in the first storage chamber 32 and second storage chamber 33 is visible and can be checked from outside.

While the description has been made in detail with reference to specific embodiment(s) thereof, it would be apparent to those skilled in the art that various changes and modifications may be made therein without departing from the spirit and scope of the above described embodiment(s).

What is claimed is:

1. A liquid cartridge comprising:

a front wall;

a rear wall spaced away from the front wall in a rear direction perpendicular to a gravitational direction in an upright posture, the rear wall spaced away from the front wall in an upward direction opposite to the gravitational direction in a rotated posture;

a bottom wall extending in a direction crossing the gravitational direction in the upright posture;

a first storage chamber configured to store liquid and having a bottom portion defined by the bottom wall in the upright posture;

a second storage chamber positioned downward relative to the first storage chamber in the upright posture, the second storage chamber having capacity less than capacity of the first storage chamber;

a liquid flow path positioned frontward relative to the rear wall in the upright posture and configured to provide communication therethrough between the second storage chamber and an outside of the liquid cartridge; and a communication opening provided at the bottom wall and configured to provide communication therethrough between the first storage chamber and the second storage chamber, the communication opening having a first end portion and a second end portion positioned downward relative to the first end portion in the rotated posture, the communication opening defining an imaginary horizontal plane extending perpendicular to the gravitational direction in the rotated posture, the imaginary horizontal plane including the second end portion of the communication opening, the first storage chamber in the rotated posture defining a first capacity above the imaginary horizontal plane and a second capacity below the imaginary horizontal plane, the first capacity being less than the second capacity, the liquid flow path being positioned downward relative to the imaginary horizontal plane in the rotated posture, wherein the rear wall has a first inner surface defining a rear portion of the first storage chamber in the upright posture, wherein the bottom wall has an end surface, the end surface and the first inner surface defining the communication opening, wherein the bottom wall has a first portion and a second portion continuously connected to the first portion in a widthwise direction perpendicular to the gravitational direction and the rear direction in the upright posture, the first portion having the end surface positioned at a rearmost part of the first portion in the upright posture, the end surface being separated away from the first inner surface and defining the communication opening, the second portion having a rear end portion and a side end surface in the upright posture, the rear end portion being connected to the first inner surface, the side end surface defining the communication opening in the upright posture, and wherein the second portion of the bottom wall further has a surface facing the first storage chamber, the surface of the second portion of the bottom wall facing the first storage chamber being inclined downward toward the communication opening in the widthwise direction in the upright posture.

2. The liquid cartridge according to claim 1, wherein the communication opening defines a first center portion in the widthwise direction in the upright posture; and wherein the first inner surface has a second center portion in the widthwise direction in the upright posture, the first center portion being positioned offset from the second center portion in the widthwise direction in the upright posture.

3. The liquid cartridge according to claim 2, wherein the rear wall has a corner in the widthwise direction in the upright posture, the communication opening is positioned at the corner.

4. The liquid cartridge according to claim 3, further comprising a side wall crossing the rear wall, the side wall having a second inner surface defining the first storage chamber in the widthwise direction in the upright posture; and wherein the communication opening is defined by the first inner surface, the second inner surface, the end surface, and the side end surface.

5. The liquid cartridge according to claim 4, wherein the communication opening has a rectangular shape when viewed from upward in the upright posture.

6. The liquid cartridge according to claim 5, wherein the communication opening has a curved corner.

7. The liquid cartridge according to claim 1, wherein the first portion of the bottom wall further has a surface facing the first storage chamber, the surfaces of the first portion and the second portion of the bottom wall facing the first storage chamber being inclined downward toward the communication opening in the upright posture.

8. The liquid cartridge according to claim 1, wherein the rear wall has an first inner surface defining at least a part of the first storage chamber and has a translucency so that a surface of the liquid stored in the first storage chamber is visible from the outside of the liquid cartridge.

9. The liquid cartridge according to claim 8, wherein the first inner surface defining at least a rear part of the second storage chamber in the upright posture; and wherein the rear wall has a translucency so that a surface of the liquid stored in the second storage chamber is visible from the outside of the liquid cartridge.

10. The liquid cartridge according to claim 1, wherein the liquid flow path is configured to allow the liquid to flow downward in the rotated posture.

11. The liquid cartridge according to claim 1, further comprising an atmosphere communication port configured to provide communication therethrough between the first storage chamber and the outside of the liquid cartridge.

12. An image forming apparatus comprising:

a liquid cartridge comprising:

a front wall;

a rear wall spaced away from the front wall in a rear direction perpendicular to a gravitational direction in an upright posture, the rear wall spaced away from the front wall in an upward direction opposite to the gravitational direction in a rotated posture;

a bottom wall extending in a direction crossing the gravitational direction in the upright posture;

a first storage chamber configured to store liquid and having a bottom portion defined by the bottom wall in the upright posture;

a second storage chamber positioned downward relative to the first storage chamber in the upright posture, the second storage chamber having capacity less than capacity of the first storage chamber;

a liquid flow path positioned frontward relative to the rear wall in the upright posture and configured to provide communication therethrough between the second storage chamber and an outside of the liquid cartridge; and a communication opening provided at the bottom wall and configured to provide communication therethrough between the first storage chamber and the second storage chamber, the communication opening having a first end portion and a second end portion positioned downward relative to the first end portion in the rotated posture, the communication opening defining an imaginary horizontal plane extending perpendicular to the gravitational direction in the rotated posture, the imaginary horizontal plane including the second end portion of the communication opening, the first storage chamber in the rotated posture defining a first capacity above the imaginary horizontal plane and a second capacity below the imaginary horizontal plane, the first capacity being less than the second capacity, the liquid flow path being positioned downward relative to the imaginary horizontal plane in the rotated posture, wherein the rear wall has a first inner surface defining a rear portion of the first storage chamber in the upright posture, wherein the bottom wall has an end surface, the end surface and the first inner surface defining the communication opening, wherein the bottom wall has a first portion and a second portion continuously connected to the first portion in a widthwise direction perpendicular to the gravitational direction and the rear direction in the upright posture, the first portion having the end surface positioned at a rearmost part of the first portion in the upright posture, the end surface being separated away from the first inner surface and defining the communication opening, the second portion having a rear end portion and a side end surface in the upright posture, the rear end portion being connected to the first inner surface, the side end surface defining the communication opening in the upright posture, and wherein the second portion of the bottom wall further has a surface facing the first storage chamber, the surface of the second portion of the bottom wall facing the first storage chamber being inclined downward toward the communication opening in the widthwise direction in the upright posture;

a cartridge attachment portion having a connector configured to be connected to the liquid flow path;

a tank having a third storage chamber configured to store the liquid supplied from the connector; and a recording head having a nozzle configured to eject the liquid supplied from the third storage chamber.

13. The image forming apparatus according to claim 12, further comprising a second atmosphere communication port configured to provide communication therethrough between the third storage chamber and the outside of the third storage chamber.

* * * * *